US011932462B2

(12) United States Patent
D'Amato

(10) Patent No.: US 11,932,462 B2
(45) Date of Patent: Mar. 19, 2024

(54) CONTAINER FOR FOOD AND CORRESPONDING BLANK

(71) Applicant: SEDA INTERNATIONAL PACKAGING GROUP SPA, Arzano Napoli (IT)

(72) Inventor: Gianfranco D'Amato, Arzano Napoli (IT)

(73) Assignee: Seda International Packaging Group SPA, Arzano Napoli (IT)

( * ) Notice: Subject to any disclaimer, the term of this patent is extended or adjusted under 35 U.S.C. 154(b) by 0 days.

(21) Appl. No.: 16/764,112

(22) PCT Filed: Nov. 15, 2018

(86) PCT No.: PCT/EP2018/081325
§ 371 (c)(1),
(2) Date: May 14, 2020

(87) PCT Pub. No.: WO2019/096883
PCT Pub. Date: May 23, 2019

(65) Prior Publication Data

US 2020/0385163 A1 Dec. 10, 2020

(30) Foreign Application Priority Data

Nov. 15, 2017 (DE) ..... 20 2017 106 941.9

(51) Int. Cl.
*B65D 5/20* (2006.01)
*B65D 5/66* (2006.01)
*B65D 85/36* (2006.01)

(52) U.S. Cl.
CPC ..... *B65D 5/2033* (2013.01); *B65D 5/667* (2013.01); *B65D 85/36* (2013.01)

(58) Field of Classification Search
CPC ..... B65D 5/667; B65D 5/2033; B65D 85/36
(Continued)

(56) References Cited

U.S. PATENT DOCUMENTS 4,339,068 A 7/1982 Brauner
4,360,147 A 11/1982 Brauner
(Continued)

FOREIGN PATENT DOCUMENTS

AU 2006100790 A4 3/2007
CN 101309835 A 11/2008
(Continued)

OTHER PUBLICATIONS

Japanese Office Action with translation retrieved from the EPO Global Dossier, from corresponding JP 2020-526514, dated Jun. 11, 2021.
(Continued)

*Primary Examiner* — Nathan J Newhouse
*Assistant Examiner* — Phillip D Schmidt
(74) *Attorney, Agent, or Firm* — Fishman Stewart PLLC

(57) ABSTRACT

A container and a corresponding blank for the container are disclosed. The container may have a lower part and an upper part for receiving food. The lower and the upper part may each have six or eight side walls and a substantially flat bottom wall or top wall connected to the side walls. A pivoting connection may be formed between a connection side wall of the lower part and a connection side wall of the upper part and free ends of the side walls end in an end plane extending obliquely to the horizontal plane. Such as configuration may make facilitate on the one hand safely storing food when the container is closed and on the other hand making the food more accessible when the container is open. In addition to the improved accessibility, the food may be largely visible on the side facing the front side wall.

21 Claims, 5 Drawing Sheets

(58) Field of Classification Search
USPC ... 229/114, 146, 906, 144, 8, 106, 109, 110, 229/108; D9/420, 423
See application file for complete search history.

(56) References Cited

U.S. PATENT DOCUMENTS

| | | | | |
|---|---|---|---|---|
| 4,763,832 | A * | 8/1988 | Forbes, Jr. | B65D 5/667 229/152 |
| 5,205,476 | A * | 4/1993 | Sorenson | B65D 5/667 229/114 |
| 5,579,989 | A * | 12/1996 | Roy | B65D 5/543 229/110 |
| 5,816,485 | A * | 10/1998 | Bernstein | B65D 5/2033 229/110 |
| 7,143,930 | B2 | 12/2006 | Money | |
| 7,431,198 | B2 * | 10/2008 | D'Amato | B65D 5/667 229/114 |
| 7,874,476 | B2 | 1/2011 | D'Amato | |
| 8,459,531 | B2 | 6/2013 | D'Amato | |
| 8,523,049 | B2 * | 9/2013 | Fitzwater | B65D 5/6626 229/114 |
| 2008/0110966 | A1 * | 5/2008 | Yocum | B65D 5/667 229/114 |

FOREIGN PATENT DOCUMENTS

| | | | |
|---|---|---|---|
| CN | 101312884 | A | 11/2008 |
| DE | 202005017678 | U1 | 3/2007 |
| FR | 2982251 | A3 | 5/2013 |
| JP | H11-236028 | A | 8/1999 |
| JP | 2007131351 | A | 5/2007 |
| JP | 2013-193211 | A | 9/2013 |
| RU | 2355612 | C2 | 5/2009 |

OTHER PUBLICATIONS

Russian Office Action related to corresponding Russian Application No. 2020115988/11 dated Nov. 6, 2020, with machine translation.
International Search Report dated Jan. 3, 2019 for corresponding PCT/EP2018/081325.
Chinese Office Action, with English translation retrieved from the EPO Global Dossier, dated Apr. 6, 2021, issued in parallel Chinese patent application No. 201880073950.3.
Ukrainian Office Action dated Feb. 2, 2022 for Ukrainian Patent Application No. a202003598 with English language summary of substantive portions of Office Action.
Japanese Office Action dated Mar. 3, 2022 for Japanese Patent No. 2020-526514 with English translation from EPO Global Dossier.
Korean Office Action dated May 6, 2022 for Korean Patent Application No. 10-2020-7016659.
Chinese Office Action dated May 6, 2022 for Chinese Application No. 201880073950.3.
Brazil Office Action dated Jul. 21, 2022 for BR application BR112020009147-2.
Notice of Reasons for Rejection dated Oct. 18, 2022 for Japanese Patent Application No. 2020-526514.
Mexico Office Action dated Sep. 25, 2023 for MX App. No. MX/a/2020/005065 (w_machine English translation).

* cited by examiner

CONTAINER FOR FOOD AND CORRESPONDING BLANK

CROSS-REFERENCE TO RELATED APPLICATIONS

This application is a National Stage Patent Application of International Patent Application No. PCT/EP2018/081325, filed Nov. 15, 2018, which claims the benefit of German Application Serial No. 20 2017 106 941.9, filed Nov. 15, 2017, the contents of each are incorporated by reference in their entireties.

TECHNICAL FIELD

The instant disclosure refers to a container for food, such as a hamburger or the like. Such a container comprises a lower part and an upper part. The parts can have different cross-sections, whereby according to an embodiment, hexagonal or octagonal cross-sections may be preferred, so that the corresponding parts each have six or eight side walls. Furthermore, the lower part has an essentially flat bottom wall and the upper part has a top wall. These are connected to the corresponding side walls.

SUMMARY

In order to be able to pivot the upper part relative to the lower part between a closed and an open position, a pivoting connection is formed between a connection side wall of the upper part and a connection side wall of the lower part, via which the connection side walls are connected to each other.

In order to be able to safely store the food when the container is closed on the one hand and to make it more easily accessible when the container is open on the other, the free ends of the side walls of the upper and lower parts end in an end plane extending obliquely to a horizontal plane. This end plane runs, in particular when the container is open, from a corresponding front side wall of the upper part obliquely downwards to a front side wall of the lower part. The food is arranged in the lower part and is easily accessible due to the relatively low height of the front side wall. In addition to the improved accessibility, the food is also presented in a way that is more advantageous for the consumer, as the food is largely visible on its side facing the front side wall.

When the container is closed, the food is contained within the container and usually not visible from the outside.

It is conceivable in the case of the container according to an embodiment that free ends of the side walls of the lower part are arranged in a first end plane and free ends of the side walls of the lower part are arranged in a second end plane, which end planes are parallel to each other. It is also conceivable that the first and second end planes run in the same end plane and thus are not spaced apart from each other.

Due to the oblique extension of the end planes, it may also be advantageous if, when the container is open, the first end plane is positioned lower than the second end plane relative to a support, whereby in this open state the bottom wall or top wall rests on this essentially horizontal support.

In order to better protect the food inside the container when closed, the side walls of the upper part from the top wall to its free ends may have a greater height than the side walls of the lower part from the bottom wall to its free ends, the connection side walls of the upper part and lower part having the same corresponding height. It is important to note that the free ends run in accordance with the first and second end planes.

It is also conceivable that the side walls of the upper part, except for the corresponding connection side wall, partially overlap the side walls of the lower part from the outside when the container is closed. It is also conceivable that the free ends of the corresponding side walls of the lower part and upper part abut each other.

In order to secure the container in its closed state, it may be advantageous if a front side wall of the upper part has two locking arms projecting substantially laterally in extension of a wall plane of the front side wall, which, when the container is closed, engage under two latching arms projecting from side walls of the lower part.

In order to be able to easily engage the latching arms with the locking arms, the front side wall above the locking arms can have a recess to accommodate each latching arm.

In order to be able to accommodate a free end of side walls of the lower part in a simple manner when closed, it is also conceivable that the side walls of the upper part adjacent to the front side wall have receiving cut-outs for partially accommodating free ends of the side walls with snap-in hooks.

In order to be able to place the container safely on a support both in the closed and open state, the bottom wall can be made essentially flat up to the side walls.

The top wall is also flat, so that when the container is open, the corresponding flat areas of the bottom wall and top wall rest on a support. However, it is possible that the flat top wall is connected to the side walls by rounded connecting sections.

An embodiment of a blank for such a container is also disclosed. Such a blank has at least one bottom wall part, side walls connected to these by folding lines which essentially define the bottom wall part in a straight line, a top wall part, and side walls connected to this top wall part by fold lines which extend outwards away from the top wall part. The corresponding pivoting connection is formed between the side walls of the upper and lower part, which are assigned to each other.

The side walls of the lower part may be of a height decreasing from the connecting wall to a front side wall and the side walls of the upper part may be of a height increasing from the corresponding connecting wall to a front side wall. This results in the corresponding arrangement of the free ends of the side walls in the first or second end plane. This arrangement is supported in particular by the fact that, if necessary, the height of the side walls between the connection side wall and the front side wall continuously decreases or increases, whereby an increase in height occurs in the upper part and a decrease in height in the lower part.

In order to be able to produce the container from the one-piece and two-dimensional blank in a simple manner, adhesive flaps can protrude laterally from at least some of the side walls. To construct the container, the side walls are then folded inwards opposite the corresponding bottom wall or top wall and joined together by the adhesive flaps. The connection is usually made by means of an adhesive applied to the respective adhesive flap. In order to construct the lower part geometrically in a different way than the upper part, the adhesive flaps on the side walls of the lower part can be essentially triangular, for example. Such a triangular-shaped adhesive flap may protrude from one side wall and is bonded to the directly adjacent side wall on the inside of the latter when the container is assembled. It is possible for each side wall to have an adhesive flap to be bonded to the directly adjacent side wall. It is also conceivable that one side wall has two lateral adhesive flaps, so that corresponding adhesive flaps need only be provided on every second side wall of the lower part. The adhesive flaps are connected to the associated side wall by a fold line.

The adhesive flaps of the side walls of the upper part can also be designed in the same way. In another embodiment, however, the adhesive flaps on the side walls of the upper part can be essentially rounded. This means that these adhesive flaps have an outer rounded shape, whereby such adhesive flaps can also be provided on each side wall and/or in pairs on a side wall of the upper part.

In order to establish the pivoting connection in a simple manner, it can be formed from a central, essentially wavy cut line and fold lines adjoining these laterally. The wavy cut line allows a simplified pivoting of the upper part relative to the lower part and the connection between upper and lower part is maintained via the adjacent fold lines.

In order to be able to easily establish the corresponding latching arms of the pivoting connection, the adhesive flaps between the front side wall and adjacent side walls of the lower part can have a latching arm cut. If the front side wall is then pivoted relative to adjacent side walls, this latching arm cut results in the corresponding latching arm, which engages with the locking arm when the container is closed.

In order to also form the locking arm in a simple manner by the one-piece two-dimensional blank, a locking arm can protrude laterally from each free side wall end of the front side wall of the upper part.

In order to arrange and connect the side walls of the upper part in a different way to the side walls of the lower part, the side walls of the upper part may be rounded inwards along their side edges in the direction of the top wall. This means that these side walls have a width that decreases towards the top wall. This results in the rounded shape of the upper part between the side walls and the top wall.

BRIEF DESCRIPTION OF THE DRAWINGS

In the following, an embodiment is explained in more detail using the attached Figures.

DETAILED DESCRIPTION

Figure 1:
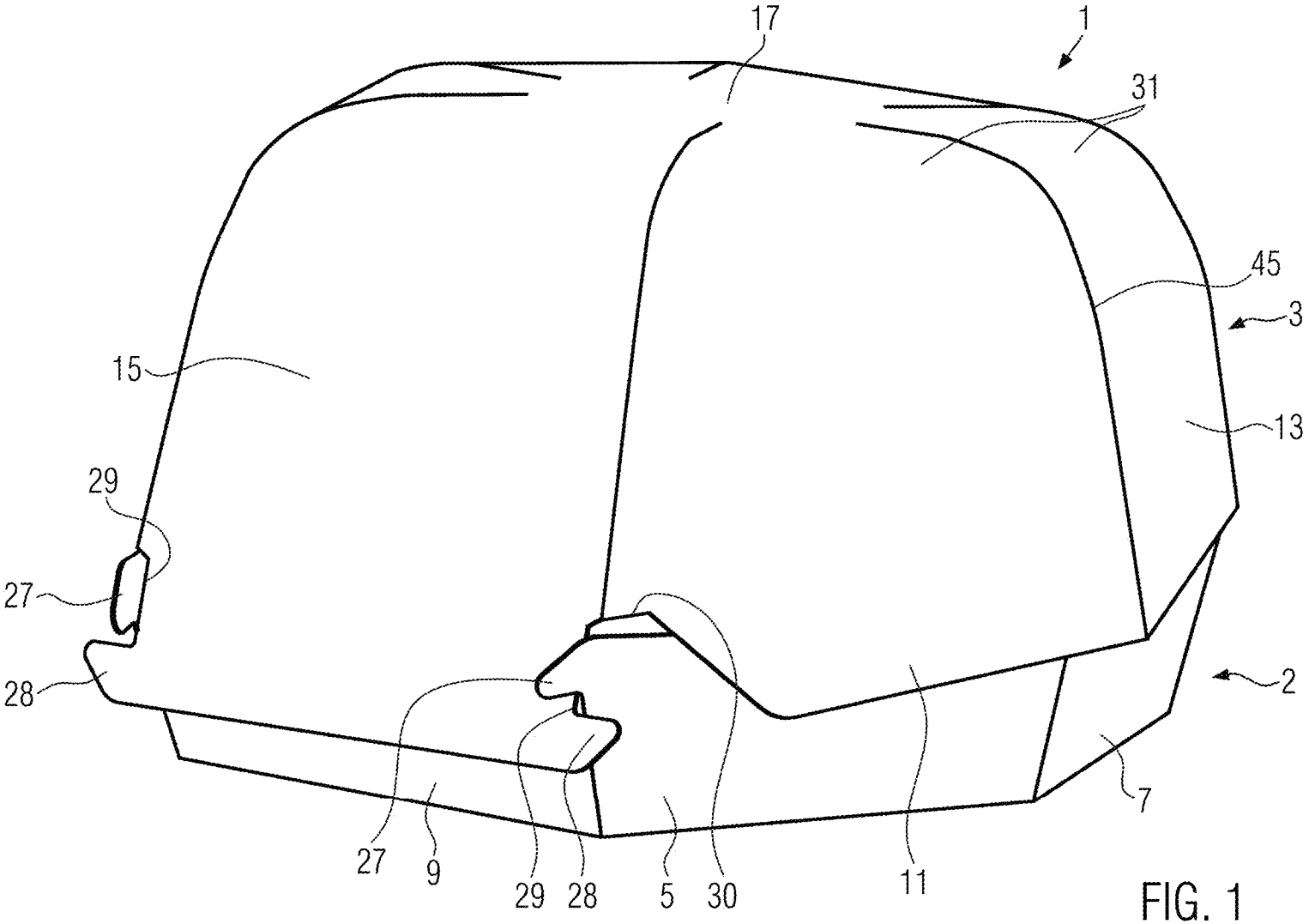
FIG. 1 shows a perspective view of a container according to the embodiment obliquely from the front.

FIG. 1 shows a perspective oblique view from the front of an embodiment of a container 1 according to an embodiment. This container has a lower part 2 and an upper part 3. The lower part 2 has a bottom wall 16, see also the blank according to FIG. 5, from which six side walls 4-9 extend obliquely upwards. This results in an approximately hexagonal cross-section for the lower part. It is also possible, for example, to use an octagonal cross-section with eight side walls and a corresponding bottom wall 16.

Figure 5:
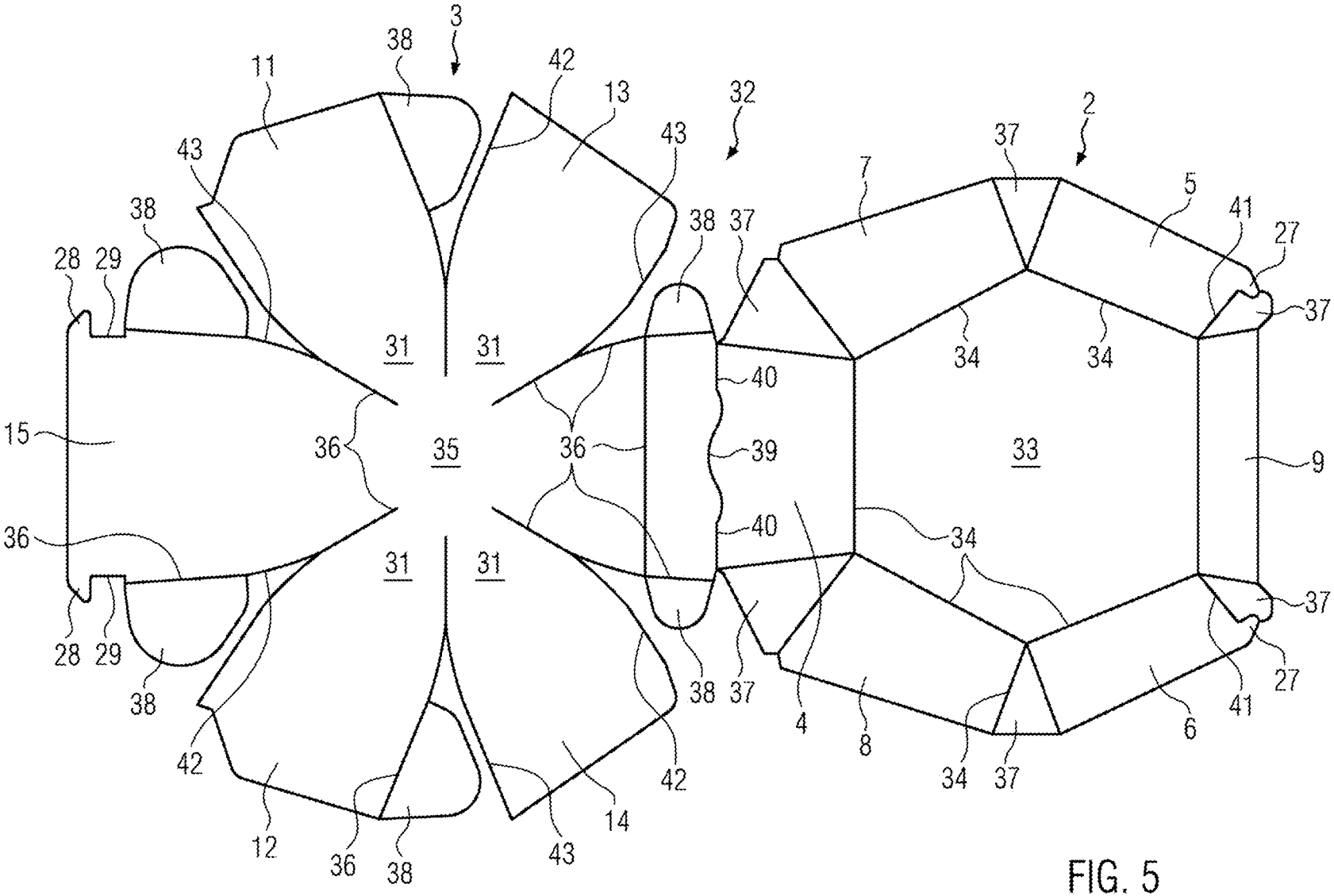
FIG. 5 shows a top view of a blank for the container from the previous Figures.

The upper part 3 also has six side walls 10-15, see again the blank according to FIG. 5, which are connected to a corresponding and essentially flat top wall 17 via rounded connecting sections 31. This top wall is arranged approximately parallel to the bottom wall 16 when the container is closed. Between the various side walls 10-15 of the upper part 3, edges 45 are formed which extend into the connecting section 31 in the direction of the top wall 17. The edges 45 are formed by fold lines, especially in the area of the connecting section and intersection lines between the side walls, see again FIG. 5. The various side walls are bonded together by means of corresponding adhesive flaps 38 so that the edges of the side walls are edge to edge.

The side walls 4-9 of the lower part 2 also have corresponding adhesive flaps 37, see FIG. 5, by which they are connected to each other.

In the area of the front side walls 9 or 15, lower part 2 and upper part 3 are detachably connected to each other. This ensures the closed condition of container 1 according to FIG. 1. For the detachable connection of the different parts locking arms 28 and latching arms 27 are provided. The latching arms 27 project from the side walls 5 and 6 adjacent to the front side wall 9 in longitudinal direction of these side walls. According to FIG. 1 these latching arms 27 are undercut by corresponding locking arms 28. These locking arms 28 protrude on both sides from the front side wall 15 of the upper part 3. They are approximately hook-shaped, whereby a corresponding hook design is also provided for the latching arms 27. It is easily possible for a user, for example, to release the corresponding locking arms 28 from their engagement by deflecting them forward, away from the front side wall 9 of the lower part, in order to open the container 1. The front side wall 15 has recesses 29 directly above the locking arms 28, in which the latching arms 27 are located. Furthermore, there are receiving cut-outs 30 between the front side wall 15 and the directly adjacent side walls 11 and 12, into which free upper ends 19 of the side walls 5 and 6 project.

This specific connecting device makes it possible to close and open container 1 in a simple manner and without additional measures.

Figure 2:
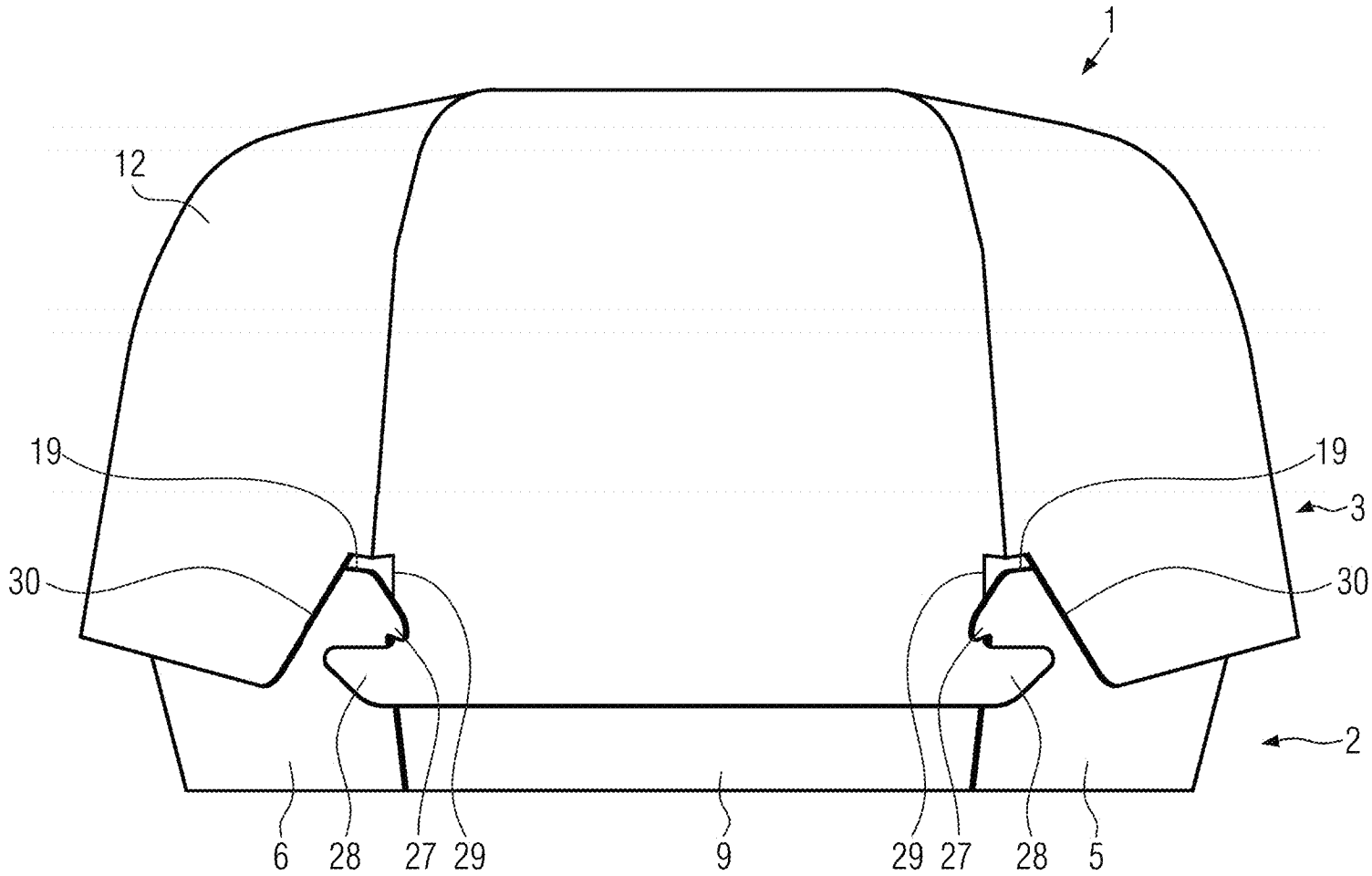
FIG. 2 shows a front view of the container as shown in FIG. 1.

In FIG. 2 the front view of container 1 from FIG. 1 is shown. In this illustration it is again recognizable in which way locking arms 28 and latching arms 27 as well as recesses 29 and receiving cut-outs 30 interact for closing the container 1. With regard to the remaining description of the side walls and the lower part and upper part reference is made to FIG. 1 as well as the following explanations. Identical parts are described in all Figures by the same reference numerals.

Figure 3:
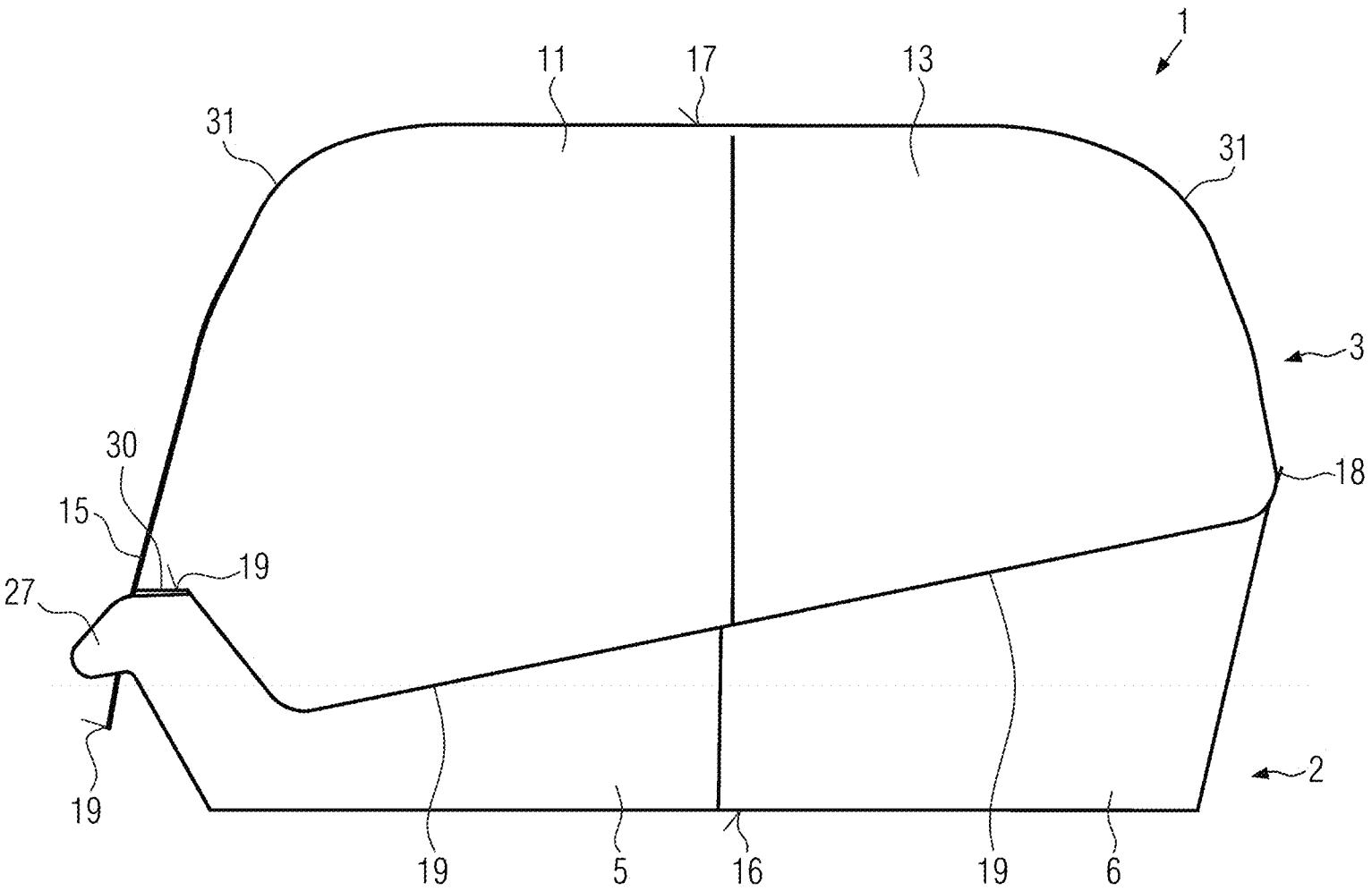
FIG. 3 shows a side view of the container according to FIG. 2.

FIG. 3 shows a side view of container 1 according to FIG. 2 or 1. In particular, it can be seen that the free ends 19 of the side walls 11 and 12 of the upper part 3 run obliquely downwards at an angle to, for example, a horizontal line. This course is only interrupted in the area of the receiving cut-out 30, whereby parts of the side wall 5 are arranged in this receiving cut-out 30 and whereby the latching arm 27 protrudes obliquely forwards from this receiving cut-out 30, see also FIG. 2. The corresponding latching arm 27 is undercut in this position by the locking arm 28.

In FIG. 3 it can be seen in particular that top wall 17 and bottom wall 16 are arranged parallel to each other when the container is closed. Opposite to the front sides the corresponding rear side walls 4 and 10 are pivotably connected to each other as connection side walls by means of a pivoting connection 18, see also FIGS. 4 and 5.

In FIG. 3 it can also be seen, see also FIG. 2, that the side walls 11 to 15, i.e. except for the connection side wall 10, overlap the corresponding side walls 5-9 of lower part 2 from the outside. This does not apply to the receiving cut-out 30, in which a part of the corresponding side wall 5 of the lower part 2 up to the free end 19 is visible.

Furthermore, FIG. 3 again shows, see also FIG. 2, that the side walls merge into the top wall 17 through the rounded connecting sections 31.

Figure 4:
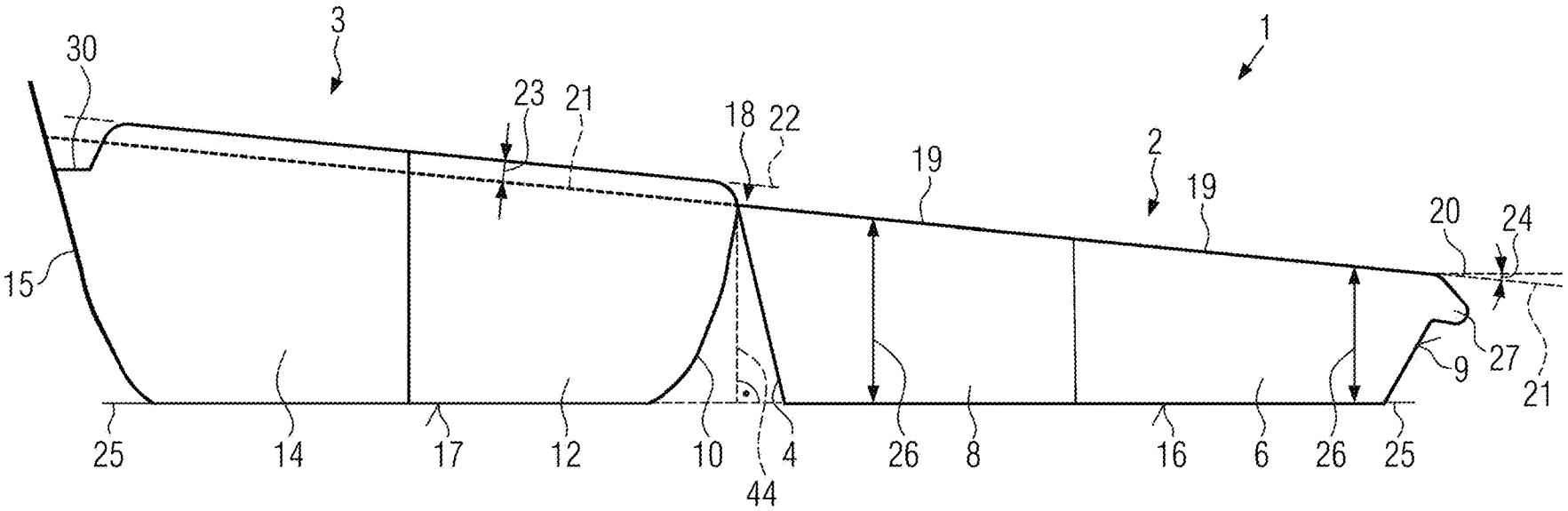
FIG. 4 shows a side view of a container in the open state, as defined in the embodiment.

In FIG. 4 the container 1 is shown in an open condition. In this state the top wall 17 and also the bottom wall 16 are in contact with a horizontal support 25. This means that in the area of the top wall and the bottom wall the lower part and the upper part respectively are essentially flat so that they lie planarly on the support 25. The contact is made in such a way that, for example, the corresponding pivoting connection 18 between the connection side wall 4 and the connection side wall 10 of the two parts is arranged at a height 44 to the support 25 and free ends 19 of all corresponding side walls essentially end in an end plane 21 or 22, which is inclined at an angle 24 to a horizontal plane 20 parallel to the support 25. A first end plane 21 may be determined for the free ends of side walls 4-9 of lower part 2 and a second end plane 22 for the free ends 19 of side walls 10-15 of upper part 3.

If an overlap of the side walls 10-15 of the upper part in the closed state with respect to the side walls 4-9 of the lower part 2 is realized, these different end planes are spaced parallel to each other, see the corresponding distance 23 between the first end plane 21 and the second end plane 22. It is also possible that the free ends 19 of all side walls end in only one end plane, in which case there would be no corresponding overlap of the side walls in the closed state. However, the container can be closed in the same way as described in FIGS. 1 to 3.

The corresponding inclination of the end planes 21 or 22 is inclined downwards towards the front side wall 9 of the lower part 2 so that a user normally seated in front of this front side wall 9 of container 1 can look down on a food in the lower part 2. The front side wall 9 of the lower part 2 is much lower than the front side wall 15 of the upper part 3, so that the food is visible over a large part of its own height and, in particular, can be easily removed from or replaced in the lower part 2 when necessary.

To achieve this oblique extension of the free ends 19, the various side walls of the lower part and the upper part have a height 26 increasing in the direction of the front side wall 9 when the container 1, see FIG. 4, is open. This side wall rises continuously along each side wall, with the front side wall 9 of the lower part 2 having the lowest height and the front side wall 15 of the upper part 3 having the highest height.

With the front side wall 15 of the upper part 3, it must still be ensured that its free end protrudes slightly beyond the second end plane 22 in order to realize the corresponding locking possibility according to FIGS. 1 to 3.

Between the front side wall 15 and the directly adjacent side wall 14, FIG. 4 shows the receiving cut-out 30.

The corresponding angle 24 can be between 5° and 30° or preferably between 7° and 18° . Furthermore it can be seen in FIG. 4 that from the side walls 5 or 6 the corresponding latching arms 27 protrude obliquely forwards and that in the closed position of container 1 the locking arms 28, see again FIG. 1 or 3, reach underneath.

FIG. 5 shows a top view of a two-dimensional and one-piece blank 32 for the production of container 1 according to the previous Figures.

In particular, FIG. 5 shows that the blank 32 has a bottom wall part 33 to form the bottom wall 16, which has a hexagonal outline. It has already been pointed out that the corresponding bottom wall part 33 can also have an octagonal outline. The side walls 4 - 9 are connected to the bottom wall part 33 via corresponding fold lines 34. FIG. 5 also shows that the corresponding height of these side walls is lowest for the front side wall 9 and highest for the connection side wall 4. The front side wall 9 has adhesive flaps 37 at both of its ends, which are separated from the directly adjacent side walls 5 and 6 by a latching arm cut 41. Further fold lines 34 are arranged between the adhesive flaps 37 and the front side wall 9, so that when the front side wall 9 is erected obliquely upwards, the corresponding adhesive flaps 37 can be folded inwards and placed against an inner side of the adjacent side walls 5 or 6 and can be fixed there, for example by means of an adhesive. The corresponding latching arm cut 41 forms the corresponding latching arm 27 in the area of the adjacent side walls 5, 6.

Corresponding intersecting lines are formed between all side walls, whereby some side walls, e.g. side walls 7, 8 and connection side wall 4, have at least one or both sides adhesive flaps. These are also connected to the associated side wall by a corresponding fold line and, in the case of side walls erected at an angle upwards, are applied from the inside to the adjacent side walls and are joined there with an adhesive.

A substantially triangular cross-section is used for the adhesive flaps 37 for the lower part 2. The adhesive flaps are designed in such a way that, when the side walls for the lower part 2 are erected, their free ends run parallel to the free ends of the side walls and end with these in the corresponding end plane, see FIG. 4.

The upper part 3 has a corresponding top wall part 35 to form the top wall 17. This part is connected to the side walls 10-15 via the corresponding connecting sections 31. Fold lines 36 are arranged in the area of the connecting sections 31, whereby the side walls 10-15 are separated from each other in continuation of these fold lines 36. Some of the side walls have at least one or even two opposite adhesive flaps 38. Thus at least the connection side wall 10 and the front side wall 15 have two lateral adhesive flaps 38 which can be connected to the respective adjacent side walls. The adhesive flaps on the upper part 3 are rounded at their free ends and, at least in a first section of their curvature, also run parallel to free ends of the adjacent side walls and end in the corresponding end plane 22, see FIG. 4.

The corresponding side edges 42 and 43 of each side wall run towards each other and are rounded off up to the corresponding fold lines 36. This design of the upper part 3 in its blank 32 results in an approximately rounded shape for the upper part 3, especially in the area of the connecting sections 31.

It has already been pointed out that the heights of the corresponding side walls of the upper part are greater than the heights of the side walls of the lower part, so that when container 1 is closed, the side walls of the upper part overlap the side walls of the lower part.

The pivoting connection 18 is formed between the two connection side walls 4 and 15. This is composed of a wavelike intersecting line 39 and fold lines 40 arranged on both sides of it. Intersecting line 39 facilitates pivoting of the lower and upper parts relative to each other, whereby the corresponding fold lines maintain the connection between the two parts.

According to an embodiment, a container for a food, in particular a hamburger or the like, is obtained in the manner described above, with a lower part and an upper part, which in an open state both rest horizontally on a support and as a whole have an oblique course along the side ends of their side walls in the direction of the user downwards. The shape of the container may be hexagonal or octagonal, the upper part in particular being rounded in the direction of the top wall. The height of the corresponding side walls is greater for the upper part than for the lower part in order to allow a corresponding overlap when closed.

The invention claimed is:

1. A container for food, the container comprising:

a lower part having a first plurality of side walls and a substantially flat bottom wall connected to the first plurality of side walls, and an upper part having a second plurality of side walls and a substantially flat top wall connected to the second plurality of side walls, wherein a pivoting connection is formed between a first connection side wall of the first plurality of side walls of the lower part and a second connection side wall of the second plurality of side walls of the upper part, free ends of the first plurality of side walls end in a first end plane extending obliquely to a horizontal plane;

free ends of the second plurality of side walls end in a second end plane extending obliquely to the horizontal plane;

the first plurality of side walls includes six or eight first side walls;

the second plurality of side walls includes six or eight second side walls;

the top wall is connected to the second side walls by rounded connecting sections;

edges are formed between the second side walls; and the edges extend between the rounded connecting sections.

2. The container according to claim 1, wherein the first end plane and the second end plane extend at angle of 7 degrees to 18 degrees relative to the horizontal plane.

3. The container according to claim 1, wherein, when the container is open, the bottom wall and the top wall rest on a substantially horizontal support.

4. The container according to claim 1, wherein the second plurality of side walls of the upper part, other than the second connection side wall, from the top wall to free ends of the second plurality of side walls, have a greater height than the first plurality of side walls of the lower part, other than the first connection side wall, from the bottom wall to the free ends of the first plurality of side walls, and the second and first connection side walls of the upper part and the lower part have substantially the same height.

5. The container according to claim 1, wherein the second plurality of side walls of the upper part, except for the second connection side wall, partially overlap the first plurality of side walls of the lower part from the outside in a closed state of the container.

6. The container according to claim 1, wherein a front side wall of the second plurality of side walls of the upper part has two locking arms projecting substantially laterally in extension of a wall plane; and in a closed state of the container, the two locking arms engage under two latching arms projecting from side walls of the first plurality of side walls of the lower part.

7. The container according to claim 6, wherein the front side wall has a recess above the locking arms for the arrangement of the latching arms.

8. The container according to claim 6, wherein the side walls of the second plurality of side walls of the upper part adjacent to the front side wall have receiving cut-outs for partially receiving free ends of the first plurality of side walls with latching arms.

9. The container according to claim 1, wherein the bottom wall is substantially flat up to the side walls.

10. The container according to claim 1, wherein, when the container is open, (i) the first end plane is arranged lower than the second end plane relative to a substantially horizontal support, and (ii) at least one of the bottom wall and the top wall rests on the substantially horizontal support.

11. The container according to claim 1, wherein the rounded connecting sections comprise curved surfaces.

12. A blank for a container, said blank comprising:

at least one bottom wall part, a first plurality of side walls connected to said bottom wall part via substantially straight first fold lines delimiting said bottom wall part, a top wall part, a second plurality of side walls connected to the top wall part, the second plurality of side walls directly connected to one another via second fold lines extending outwards away from the top wall part, and a pivoting connection formed between connection side walls of the second plurality of side walls and the first plurality of side walls, respectively;

wherein adhesive flaps project laterally from at least some of the second plurality of side walls, the adhesive flaps being configured to join together adjacent side walls of the second plurality of side walls.

13. The blank according to claim 12, wherein the first plurality of side walls includes a first connection side wall and a first front side wall;

the first plurality of side walls, other than the first connection side wall and the first front side wall, are formed with a height decreasing from the first connection side wall to the first front side wall;

the second plurality of side walls includes a second connection side wall and a second front side wall; and the second plurality of side walls, other than the second connection side wall and the second front side wall, are formed with a height increasing from the second connection side wall to the second front side wall.

14. The blank according to claim 12, wherein a height of the side walls of the first plurality of side walls and the second plurality of side walls between respective connection side walls and front side walls continuously decreases or increases.

15. The blank according to claim 12, wherein second adhesive flaps project from the second plurality of side walls; and the second adhesive flaps include free ends.

16. The blank according to claim 12, wherein adhesive flaps project laterally from at least some of the second plurality of side walls and the adhesive flaps include free ends that are rounded.

17. The blank according to claim 16, wherein additional adhesive flaps project laterally from at least some of the first plurality of side walls and are substantially triangular in shape.

18. The blank according to claim 12, wherein the pivoting connection is formed by a central, substantially wave-shaped cutting line and laterally adjacent third fold lines.

19. The blank according to claim 12, wherein the first plurality of side walls includes a front side wall; and adhesive flaps project from at least some of the first plurality of side walls and have a locking arm cut between the front side wall and adjacent side walls of the first plurality of side walls.

20. The blank according to claim 12, wherein locking arms project laterally from a free end of a front side wall of the second plurality of side walls.

21. The blank according to claim 12, wherein the second plurality of side walls are rounded inwards along side edges of the second plurality of side walls.

* * * * *